US008015725B2

(12) United States Patent
Vives

(10) Patent No.: US 8,015,725 B2
(45) Date of Patent: Sep. 13, 2011

(54) METHOD AND MACHINE FOR THE SINTERING AND/OR DRYING OF POWDER MATERIALS USING INFRARED RADIATION

(75) Inventor: Joan Iglesias Vives, Santa Eulalia de Roncana (ES)

(73) Assignee: DOS-I Solutions, S.L., Santa Eulàlia de Ronçana (Barcelona) (ES)

( * ) Notice: Subject to any disclaimer, the term of this patent is extended or adjusted under 35 U.S.C. 154(b) by 395 days.

(21) Appl. No.: 11/630,039

(22) PCT Filed: Sep. 21, 2004

(86) PCT No.: PCT/ES2004/000412

§ 371 (c)(1),
(2), (4) Date: Jan. 16, 2007

(87) PCT Pub. No.: WO2005/114077

PCT Pub. Date: Dec. 1, 2005

(65) Prior Publication Data

US 2008/0047160 A1 Feb. 28, 2008

(51) Int. Cl.
*F26B 3/31* (2006.01)

(52) U.S. Cl. ..... 34/266; 34/344; 34/347; 34/401; 430/65; 430/348; 540/23; 540/44; 423/110; 423/219; 399/111; 399/116; 156/238; 156/289

(58) Field of Classification Search ..... 34/266, 34/344, 347, 401; 430/65, 348; 540/23, 540/44; 156/238, 289; 423/110, 219; 399/111, 399/116; 435/3, 6

See application file for complete search history.

(56) References Cited

U.S. PATENT DOCUMENTS

| | | | | | |
|---|---|---|---|---|---|
| 1,447,888 | A | * | 3/1923 | Reed | 423/110 |
| 1,706,421 | A | * | 3/1929 | Trent | 202/102 |
| 1,722,434 | A | * | 7/1929 | Lester | 162/171 |
| 1,745,875 | A | * | 2/1930 | Styer | 423/219 |
| 1,756,896 | A | * | 4/1930 | Wisner | 44/591 |
| 1,923,161 | A | * | 8/1933 | McRae | 34/123 |
| 1,979,280 | A | * | 11/1934 | Mitchell | 423/110 |
| 2,259,013 | A | * | 10/1941 | Taylor | 91/263 |
| 2,391,195 | A | * | 12/1945 | Ross et al. | 34/418 |
| 2,408,810 | A | * | 10/1946 | Puening | 241/17 |
| 2,413,420 | A | * | 12/1946 | Stephanoff | 34/364 |
| 2,460,546 | A | * | 2/1949 | Stephanoff | 523/319 |
| 2,463,866 | A | * | 3/1949 | Green | 526/67 |
| 2,556,514 | A | * | 6/1951 | Bergstrom | 208/148 |
| 2,593,583 | A | * | 4/1952 | Lontz | 528/502 F |
| 2,616,604 | A | * | 11/1952 | Folsom | 53/432 |
| 2,626,482 | A | * | 1/1953 | Munday et al. | 405/36 |
| 2,733,051 | A | * | 1/1956 | Street | 366/84 |
| 2,751,301 | A | * | 6/1956 | Leslie et al. | 426/455 |
| 2,766,283 | A | * | 10/1956 | Turner | 564/59 |
| 2,775,551 | A | * | 12/1956 | Nathan et al. | 201/9 |
| 2,833,750 | A | * | 5/1958 | Vickers | 528/481 |
| 2,838,392 | A | * | 6/1958 | Aloysius | 75/343 |
| 2,841,771 | A | * | 7/1958 | Dunleavey | 333/181 |
| 2,911,065 | A | * | 11/1959 | Yellott et al. | 96/418 |
| 2,988,782 | A | * | 6/1961 | Esperanza et al. | 264/69 |
| 2,999,788 | A | * | 9/1961 | Morgan | 162/146 |
| 3,022,159 | A | * | 2/1962 | Howard et al. | 75/617 |
| 3,023,175 | A | * | 2/1962 | Rodman, Jr. | 521/58 |
| 3,032,430 | A | * | 5/1962 | Heller | 106/477 |
| 3,047,473 | A | * | 7/1962 | Schmidt | 201/4 |
| 3,058,895 | A | * | 10/1962 | Williams | 205/653 |
| 3,060,210 | A | * | 10/1962 | De Groote et al. | 507/244 |
| 3,150,926 | A | * | 9/1964 | Pope et al. | 423/431 |
| 3,158,994 | A | * | 12/1964 | Hodgson | 60/220 |
| 3,162,556 | A | * | 12/1964 | Ravich | 438/56 |
| 3,189,080 | A | * | 6/1965 | Overcashier et al. | 159/25.2 |
| 3,192,290 | A | * | 6/1965 | Polon | 264/117 |
| 3,208,823 | A | * | 9/1965 | Frankle et al. | 524/493 |
| 3,211,652 | A | * | 10/1965 | Hinkamp | 508/434 |
| 3,218,188 | A | * | 11/1965 | Lippe et al. | 127/43 |
| 3,222,797 | A | * | 12/1965 | Zies | 34/424 |
| 3,248,228 | A | * | 4/1966 | Gidlow et al. | 426/453 |
| 3,252,228 | A | * | 5/1966 | Ehrenfreund | 34/584 |
| 3,254,881 | A | * | 6/1966 | Rusk | 432/51 |
| 3,260,571 | A | * | 7/1966 | Gruber | 423/289 |
| 3,269,025 | A | * | 8/1966 | Dryden et al. | 426/385 |
| 3,291,672 | A | * | 12/1966 | Sonneborn et al. | 156/289 |
| 3,310,293 | A | * | 3/1967 | Zimmerman | 366/6 |
| 3,312,054 | A | * | 4/1967 | Anderson et al. | 60/531 |
| 3,315,756 | A | * | 4/1967 | Fly et al. | 180/292 |
| 3,335,094 | A | * | 8/1967 | Darby | 252/183.14 |
| 3,356,728 | A | * | 12/1967 | Cimerol et al. | 564/422 |
| 3,412,721 | A | * | 11/1968 | Thompson | 123/90.51 |
| 3,432,262 | A | * | 3/1969 | Ravich | 423/566 |
| 3,436,025 | A | * | 4/1969 | Sheldon | 241/15 |
| 3,456,357 | A | * | 7/1969 | Griffith | 34/401 |
| 3,462,514 | A | * | 8/1969 | Carpenter et al. | 525/43 |
| 3,520,066 | A | * | 7/1970 | Meade | 34/344 |
| 3,562,137 | A | * | 2/1971 | Gehring | 204/258 |

(Continued)

FOREIGN PATENT DOCUMENTS

| | | | | |
|---|---|---|---|---|
| DE | 1906278 | | | 11/1970 |
| DE | 3732779 | A1 | * | 4/1991 |
| EP | 829454 | A1 | * | 3/1998 |
| EP | 1215273 | A2 | * | 6/2002 |
| ES | 471554 | | | 2/1979 |
| GB | 1222033 | | | 2/1971 |
| JP | 56006142 | A | * | 1/1981 |
| JP | 56113265 | A | * | 9/1981 |
| JP | 58031038 | A | * | 2/1983 |
| JP | 59082185 | A | * | 5/1984 |

(Continued)

*Primary Examiner* — Stephen M. Gravini

(74) *Attorney, Agent, or Firm* — Dowell & Dowell, P.C.

(57) ABSTRACT

The invention relates to a method and a device, as well as the variants thereof, which operates continuously or discontinuously for the agglomeration and/or drying of powder materials using selective infrared irradiation on a surface which is continually supplied with renewed powder, with or without the spraying of liquids. The process can be performed in sealed conditions or open to the atmosphere, with or without the recovery of volatile components.

4 Claims, 3 Drawing Sheets

U.S. PATENT DOCUMENTS

| | | | | | |
|---|---|---|---|---|---|
| 3,566,582 | A | * | 3/1971 | Yankura | 5/219 |
| 3,607,527 | A | * | 9/1971 | Morley et al. | 156/238 |
| 3,707,435 | A | * | 12/1972 | Morley | 428/207 |
| 3,817,743 | A | * | 6/1974 | Sardisco | 5/583 |
| 4,173,530 | A | * | 11/1979 | Smith et al. | 209/9 |
| 4,178,231 | A | * | 12/1979 | Smith et al. | 209/3 |
| 4,178,233 | A | * | 12/1979 | Smith et al. | 209/3 |
| 4,224,039 | A | * | 9/1980 | Smith et al. | 44/551 |
| 4,244,699 | A | * | 1/1981 | Smith et al. | 44/502 |
| 4,265,737 | A | * | 5/1981 | Smith et al. | 209/3 |
| 4,351,849 | A | * | 9/1982 | Meade | 426/61 |
| 4,439,385 | A | * | 3/1984 | Kuhls et al. | 264/37.18 |
| 4,447,245 | A | * | 5/1984 | Smith et al. | 44/595 |
| 4,457,703 | A | * | 7/1984 | Ross | 432/13 |
| 4,461,625 | A | * | 7/1984 | Smith et al. | 431/12 |
| 4,579,525 | A | * | 4/1986 | Ross | 432/13 |
| 4,693,013 | A | * | 9/1987 | Pabst et al. | 34/266 |
| 4,711,009 | A | * | 12/1987 | Cornelison et al. | 29/890 |
| 4,774,304 | A | * | 9/1988 | Kuhls et al. | 526/247 |
| 4,781,933 | A | | 11/1988 | Fraioli | |
| 4,833,172 | A | * | 5/1989 | Schwarz et al. | 521/62 |
| 4,853,148 | A | * | 8/1989 | Tom et al. | 252/194 |
| 4,861,644 | A | * | 8/1989 | Young et al. | 428/195.1 |
| 4,871,485 | A | * | 10/1989 | Rivers, Jr. | 554/144 |
| 4,877,679 | A | * | 10/1989 | Leatherman et al. | 442/58 |
| 4,892,779 | A | * | 1/1990 | Leatherman et al. | 428/220 |
| 4,927,802 | A | * | 5/1990 | Leatherman | 503/214 |
| 4,957,787 | A | * | 9/1990 | Reinhardt et al. | 428/24 |
| 4,959,208 | A | * | 9/1990 | Chakrabarti et al. | 424/486 |
| 4,973,430 | A | * | 11/1990 | Rivers, Jr. | 554/144 |
| 5,032,450 | A | * | 7/1991 | Rechlicz et al. | 428/196 |
| 5,035,886 | A | * | 7/1991 | Chakrabarti et al. | 424/405 |
| 5,047,283 | A | * | 9/1991 | Leatherman et al. | 428/209 |
| 5,071,645 | A | * | 12/1991 | Johnson et al. | 424/486 |
| 5,150,531 | A | * | 9/1992 | Meglio | 34/376 |
| 5,161,233 | A | * | 11/1992 | Matsuo et al. | 399/136 |
| 5,169,307 | A | * | 12/1992 | Frye | 432/14 |
| 5,275,484 | A | * | 1/1994 | Shohet | 366/132 |
| 5,338,353 | A | * | 8/1994 | Uchino et al. | 106/426 |
| 5,360,537 | A | * | 11/1994 | Strumskis | 208/400 |
| 5,430,118 | A | * | 7/1995 | Powers et al. | 526/347 |
| 5,432,000 | A | * | 7/1995 | Young et al. | 428/372 |
| 5,498,478 | A | * | 3/1996 | Hansen et al. | 428/372 |
| 5,519,948 | A | * | 5/1996 | Raehse et al. | 34/347 |
| 5,582,670 | A | * | 12/1996 | Andersen et al. | 156/242 |
| 5,638,103 | A | * | 6/1997 | Obata et al. | 347/164 |
| 5,645,917 | A | * | 7/1997 | Ejiri et al. | 428/141 |
| 5,695,902 | A | * | 12/1997 | Mikuriya et al. | 430/108.6 |
| 5,727,578 | A | * | 3/1998 | Matthews | 134/61 |
| 5,756,148 | A | * | 5/1998 | Ejiri et al. | 427/128 |
| 5,763,046 | A | * | 6/1998 | Ejiri et al. | 428/141 |
| 5,780,141 | A | * | 7/1998 | Ejiri et al. | 428/323 |
| 5,792,543 | A | * | 8/1998 | Ejiri et al. | 428/141 |
| 5,794,521 | A | * | 8/1998 | Yung | 99/327 |
| 5,795,646 | A | * | 8/1998 | Ejiri et al. | 428/323 |
| 5,811,166 | A | * | 9/1998 | Ejiri et al. | 428/840.1 |
| 5,811,172 | A | * | 9/1998 | Ejiri et al. | 428/141 |
| 5,827,600 | A | * | 10/1998 | Ejiri et al. | 428/141 |
| 5,851,622 | A | * | 12/1998 | Ejiri et al. | 428/840.1 |
| 5,879,722 | A | * | 3/1999 | Andersen et al. | 156/501 |
| 5,891,963 | A | * | 4/1999 | Brookhart et al. | 525/326.1 |
| 5,961,923 | A | * | 10/1999 | Nova et al. | 506/4 |
| 5,967,021 | A | * | 10/1999 | Yung | 99/327 |
| 5,983,057 | A | * | 11/1999 | Matsuo et al. | 399/207 |
| 5,985,408 | A | * | 11/1999 | Ejiri et al. | 428/141 |
| 5,997,642 | A | * | 12/1999 | Solayappan et al. | 118/50 |
| 6,015,602 | A | * | 1/2000 | Ejiri et al. | 428/840.2 |
| 6,017,496 | A | * | 1/2000 | Nova et al. | 506/28 |
| 6,020,022 | A | * | 2/2000 | Ejiri et al. | 427/128 |
| 6,025,082 | A | * | 2/2000 | Ejiri et al. | 428/840.6 |
| 6,100,026 | A | * | 8/2000 | Nova et al. | 506/41 |
| 6,100,305 | A | * | 8/2000 | Miyake et al. | 521/53 |
| 6,116,184 | A | * | 9/2000 | Solayappan et al. | 118/50.1 |
| 6,126,901 | A | * | 10/2000 | Patch et al. | 422/64 |
| 6,140,395 | A | * | 10/2000 | Hatsuda et al. | 523/319 |
| 6,143,403 | A | * | 11/2000 | Ejiri et al. | 428/840.2 |
| 6,155,726 | A | * | 12/2000 | Ishikawa et al. | 396/575 |
| 6,181,393 | B1 | * | 1/2001 | Enomoto et al. | 349/86 |
| 6,183,933 | B1 | * | 2/2001 | Ishikawa et al. | 430/256 |
| 6,196,113 | B1 | * | 3/2001 | Yung | 99/327 |
| 6,207,236 | B1 | * | 3/2001 | Araki et al. | 427/386 |
| 6,210,775 | B1 | * | 4/2001 | Ejiri et al. | 428/840.1 |
| 6,258,733 | B1 | * | 7/2001 | Solayappan et al. | 438/785 |
| 6,284,459 | B1 | * | 9/2001 | Nova et al. | 506/15 |
| 6,306,658 | B1 | * | 10/2001 | Turner et al. | 436/37 |
| 6,319,668 | B1 | * | 11/2001 | Nova et al. | 506/28 |
| 6,329,139 | B1 | * | 12/2001 | Nova et al. | 506/30 |
| 6,340,588 | B1 | * | 1/2002 | Nova et al. | 506/16 |
| 6,403,059 | B1 | * | 6/2002 | Martin et al. | 424/49 |
| 6,419,174 | B1 | * | 7/2002 | McGill et al. | 427/249.1 |
| 6,455,316 | B1 | * | 9/2002 | Turner et al. | 436/37 |
| 6,493,013 | B2 | * | 12/2002 | Obata et al. | 347/139 |
| 6,537,714 | B2 | * | 3/2003 | Kaya et al. | 430/45.32 |
| 6,537,715 | B2 | * | 3/2003 | Mizoo et al. | 430/108.22 |
| 6,585,509 | B2 | * | 7/2003 | Young et al. | 431/11 |
| 6,610,844 | B2 | * | 8/2003 | Ng et al. | 540/41 |
| 6,615,071 | B1 | * | 9/2003 | Casscells et al. | 600/474 |
| 6,706,518 | B2 | * | 3/2004 | Lorenz et al. | 435/264 |
| 6,722,295 | B2 | * | 4/2004 | Zauderer | 110/345 |
| 6,725,670 | B2 | * | 4/2004 | Smith et al. | 62/6 |
| 6,763,261 | B2 | * | 7/2004 | Casscells et al. | 600/474 |
| 6,773,857 | B2 | * | 8/2004 | Nakamura et al. | 430/65 |
| 6,787,112 | B1 | * | 9/2004 | Turner et al. | 422/130 |
| 6,796,123 | B2 | * | 9/2004 | Lasker | 60/520 |
| 6,864,092 | B1 | * | 3/2005 | Turner et al. | 436/37 |
| 6,881,363 | B2 | * | 4/2005 | Carlson et al. | 506/37 |
| 6,887,991 | B1 | * | 5/2005 | Ng et al. | 540/23 |
| 6,890,492 | B1 | * | 5/2005 | Turner et al. | 506/33 |
| 6,924,149 | B2 | * | 8/2005 | Turner et al. | 436/148 |
| 7,101,523 | B2 | * | 9/2006 | Mori et al. | 423/338 |
| 7,112,669 | B2 | * | 9/2006 | Ng et al. | 540/23 |
| 7,122,156 | B2 | * | 10/2006 | Bergh et al. | 422/102 |
| 7,138,016 | B2 | * | 11/2006 | Reardon et al. | 118/313 |
| 7,143,586 | B2 | * | 12/2006 | Smith et al. | 62/6 |
| 7,150,994 | B2 | * | 12/2006 | Bergh et al. | 436/37 |
| 7,247,421 | B2 | * | 7/2007 | Ohzeki | 430/350 |
| 7,250,249 | B2 | * | 7/2007 | Yoshioka | 430/619 |
| 7,261,867 | B1 | * | 8/2007 | Sandford et al. | 423/45 |
| 7,288,229 | B2 | * | 10/2007 | Turner et al. | 422/130 |
| 7,314,693 | B2 | * | 1/2008 | Ikegami et al. | 430/58.75 |
| 7,338,749 | B2 | * | 3/2008 | Kunita | 430/306 |
| 7,393,699 | B2 | * | 7/2008 | Tran | 438/1 |
| 7,416,641 | B2 | * | 8/2008 | Denison | 202/99 |
| 7,426,409 | B2 | * | 9/2008 | Casscells et al. | 600/474 |
| 7,429,444 | B2 | * | 9/2008 | Yoshioka | 430/139 |
| 7,429,447 | B2 | * | 9/2008 | Ohzeki | 430/350 |
| 7,454,936 | B2 | * | 11/2008 | Michel et al. | 72/69 |
| 7,481,453 | B2 | * | 1/2009 | Breed | 280/738 |
| 7,493,969 | B2 | * | 2/2009 | Burnett et al. | 175/88 |
| 7,569,354 | B2 | * | 8/2009 | Okano et al. | 435/7.1 |
| 7,622,194 | B2 | * | 11/2009 | Ibuki | 428/447 |
| 7,648,164 | B2 | * | 1/2010 | Breed | 280/736 |
| 7,740,273 | B2 | * | 6/2010 | Breed | 280/736 |
| 7,762,580 | B2 | * | 7/2010 | Breed | 280/730.2 |
| 7,767,180 | B2 | * | 8/2010 | Panz et al. | 423/339 |
| 7,767,850 | B2 | * | 8/2010 | Brostrom et al. | 562/557 |
| 7,790,292 | B2 | * | 9/2010 | Colborn et al. | 428/447 |
| 7,816,301 | B2 | * | 10/2010 | Ikeuchi et al. | 502/402 |
| 7,828,997 | B2 | * | 11/2010 | Otoshi et al. | 264/40.6 |
| 7,832,762 | B2 | * | 11/2010 | Breed | 280/735 |
| 7,867,555 | B2 | * | 1/2011 | O'Dell et al. | 427/195 |
| 7,896,934 | B2 | * | 3/2011 | Curello et al. | 48/61 |
| 2001/0034064 | A1 | * | 10/2001 | Turner et al. | 436/34 |
| 2002/0005888 | A1 | * | 1/2002 | Obata et al. | 347/139 |
| 2002/0023875 | A1 | * | 2/2002 | Lorenz et al. | 210/601 |
| 2002/0045114 | A1 | * | 4/2002 | Kaya et al. | 430/45 |
| 2002/0045265 | A1 | * | 4/2002 | Bergh et al. | 436/37 |
| 2002/0048536 | A1 | * | 4/2002 | Bergh et al. | 422/130 |
| 2002/0061271 | A1 | * | 5/2002 | Zauderer | 423/243.08 |
| 2002/0072006 | A1 | * | 6/2002 | Mizoo et al. | 430/108.22 |
| 2002/0086253 | A1 | * | 7/2002 | Young et al. | 431/11 |
| 2002/0117388 | A1 | * | 8/2002 | Denison | 201/25 |
| 2002/0135788 | A1 | * | 9/2002 | Arakawa et al. | 358/1.1 |
| 2003/0028114 | A1 | * | 2/2003 | Casscells et al. | 600/474 |
| 2003/0055274 | A1 | * | 3/2003 | Ng et al. | 552/638 |
| 2003/0118927 | A1 | * | 6/2003 | Nakamura et al. | 430/65 |
| 2003/0121906 | A1 | * | 7/2003 | Abbott et al. | 219/543 |

2003/0127776 A1* 7/2003 Carlson et al. ..... 264/406
2003/0157721 A1* 8/2003 Turner et al. ..... 436/34
2003/0171691 A1* 9/2003 Casscells et al. ..... 600/549
2003/0190755 A1* 10/2003 Turner et al. ..... 436/37
2003/0192324 A1* 10/2003 Smith et al. ..... 62/6
2003/0199515 A1* 10/2003 Mudipalli et al. ..... 514/249
2004/0004559 A1* 1/2004 Rast ..... 341/34
2004/0083731 A1* 5/2004 Lasker ..... 60/645
2004/0234906 A1* 11/2004 Ohzeki et al. ..... 430/348
2004/0259033 A1* 12/2004 Kunita ..... 430/300
2005/0038120 A1* 2/2005 Brostrom et al. ..... 514/562
2005/0047985 A1* 3/2005 Mori et al. ..... 423/335
2005/0069827 A1* 3/2005 Nariyuki et al. ..... 430/619
2005/0079132 A1* 4/2005 Wang et al. ..... 424/1.11
2005/0107870 A1* 5/2005 Wang et al. ..... 623/1.44
2005/0118518 A1* 6/2005 Ikegami et al. ..... 430/58.75
2005/0126171 A1* 6/2005 Lasker ..... 60/645
2005/0175665 A1* 8/2005 Hunter et al. ..... 424/423
2005/0175703 A1* 8/2005 Hunter et al. ..... 424/486
2005/0178395 A1* 8/2005 Hunter et al. ..... 128/898
2005/0178396 A1* 8/2005 Hunter et al. ..... 128/898
2005/0179156 A1* 8/2005 Carlson et al. ..... 264/40.1
2005/0182155 A1* 8/2005 O'Dell et al. ..... 523/200
2005/0182463 A1* 8/2005 Hunter et al. ..... 607/115
2005/0183731 A1* 8/2005 Hunter et al. ..... 128/898
2005/0186244 A1* 8/2005 Hunter et al. ..... 424/423
2005/0187140 A1* 8/2005 Hunter et al. ..... 514/2
2005/0196421 A1* 9/2005 Hunter et al. ..... 424/423
2005/0208095 A1* 9/2005 Hunter et al. ..... 424/423
2005/0215764 A1* 9/2005 Tuszynski et al. ..... 530/358
2005/0249667 A1* 11/2005 Tuszynski et al. ..... 424/9.3
2005/0256094 A1* 11/2005 Ng et al. ..... 514/172
2005/0272832 A1* 12/2005 Aoshima ..... 523/160
2005/0274123 A1* 12/2005 Smith et al. ..... 62/6
2006/0102390 A1* 5/2006 Burnett et al. ..... 175/66
2006/0105359 A1* 5/2006 Favuzzi et al. ..... 435/6
2006/0110691 A9* 5/2006 Ohzeki et al. ..... 430/348
2006/0116441 A1* 6/2006 Aoshima et al. ..... 523/160
2006/0133968 A1* 6/2006 Dales et al. ..... 422/130
2006/0134793 A1* 6/2006 Key et al. ..... 436/63
2006/0141243 A1* 6/2006 Ibuki ..... 428/334
2006/0160035 A1* 7/2006 Yoshioka et al. ..... 430/348
2006/0172235 A1* 8/2006 Ohzeki ..... 430/619
2006/0183063 A1* 8/2006 Yoshioka et al. ..... 430/619
2006/0199113 A1* 9/2006 Ohzeki ..... 430/348
2006/0210934 A1* 9/2006 Yoshioka ..... 430/619
2006/0216661 A1* 9/2006 Fukui et al. ..... 430/619
2006/0232052 A1* 10/2006 Breed ..... 280/735
2006/0270292 A1* 11/2006 Otoshi et al. ..... 442/39
2006/0286186 A1* 12/2006 Bird et al. ..... 424/750
2007/0003803 A1* 1/2007 Omasa et al. ..... 429/21
2007/0003885 A1* 1/2007 Yoshioka ..... 430/619
2007/0010702 A1* 1/2007 Wang et al. ..... 600/8
2007/0026348 A1* 2/2007 Ohzeki et al. ..... 430/619
2007/0029252 A1* 2/2007 Dunson et al. ..... 210/603
2007/0054143 A1* 3/2007 Otoshi ..... 428/532
2007/0059618 A1* 3/2007 Kurimoto et al. ..... 430/58.5
2007/0059763 A1* 3/2007 Okano et al. ..... 435/7.1
2007/0065762 A1* 3/2007 Deguchi et al. ..... 430/619
2007/0065764 A1* 3/2007 Taniguchi et al. ..... 430/619
2007/0129492 A1* 6/2007 Colborn et al. ..... 525/100
2007/0196778 A1* 8/2007 Ohzeki et al. ..... 430/619
2007/0207079 A1* 9/2007 Brady et al. ..... 423/244.1
2007/0207335 A1* 9/2007 Karandikar et al. ..... 428/560
2007/0228703 A1* 10/2007 Breed ..... 280/735
2007/0267774 A1* 11/2007 Ueda ..... 264/211.11
2007/0275183 A1* 11/2007 Hashimoto ..... 428/1.2
2007/0280877 A1* 12/2007 Suchanek et al. ..... 423/625
2007/0286788 A1* 12/2007 Panz et al. ..... 423/335
2007/0286998 A1* 12/2007 Hashimoto ..... 428/220
2007/0299203 A1* 12/2007 Panz et al. ..... 524/588
2007/0299219 A1* 12/2007 Higashioji et al. ..... 525/535
2008/0027237 A1* 1/2008 Ng et al. ..... 552/502
2008/0047160 A1* 2/2008 Vives ..... 34/266
2008/0056064 A1* 3/2008 Tanaka ..... 366/339
2008/0061481 A1* 3/2008 Otoshi ..... 264/638
2008/0067792 A1* 3/2008 Breed ..... 280/734
2008/0075922 A1* 3/2008 Ueda ..... 428/156
2008/0081167 A1* 4/2008 Ueda ..... 428/221
2008/0081278 A1* 4/2008 Matsumoto et al. ..... 430/111.35
2008/0082237 A1* 4/2008 Breed ..... 701/45
2008/0090034 A1* 4/2008 Harrison et al. ..... 428/32.71
2008/0107832 A1* 5/2008 Takeda ..... 428/1.4
2008/0108005 A1* 5/2008 Carpenter ..... 432/13
2008/0170982 A1* 7/2008 Zhang et al. ..... 423/447.3
2008/0191153 A1* 8/2008 Marganski et al. ..... 250/492.21
2008/0204643 A1* 8/2008 Sasada ..... 349/117
2008/0206113 A1* 8/2008 Stepan et al. ..... 422/129
2008/0216906 A1* 9/2008 Curello et al. ..... 137/614.03
2008/0243342 A1* 10/2008 Breed ..... 701/45
2008/0269850 A1* 10/2008 Dodo ..... 607/96
2008/0272580 A1* 11/2008 Breed ..... 280/735
2008/0284145 A1* 11/2008 Breed ..... 280/736
2008/0299188 A1* 12/2008 Appel et al. ..... 424/457
2008/0299875 A1* 12/2008 Duescher ..... 451/56
2009/0004262 A1* 1/2009 Shaw et al. ..... 424/456
2009/0011293 A1* 1/2009 Wood et al. ..... 429/17
2009/0021728 A1* 1/2009 Heinz et al. ..... 356/244
2009/0028948 A1* 1/2009 Payne et al. ..... 424/489
2009/0036667 A1* 2/2009 Hashimoto et al. ..... 536/69
2009/0041500 A1* 2/2009 Mitsumori et al. ..... 399/159
2009/0042200 A1* 2/2009 Okano et al. ..... 435/6
2009/0042739 A1* 2/2009 Okano et al. ..... 506/12
2009/0053634 A1* 2/2009 Mitsumori et al. ..... 430/57.1
2009/0054637 A1* 2/2009 Ueda ..... 536/56
2009/0059138 A1* 3/2009 Matsumoto et al. ..... 349/106
2009/0062427 A1* 3/2009 Tornow et al. ..... 523/223
2009/0076286 A1* 3/2009 Heilek et al. ..... 548/555
2009/0115083 A1* 5/2009 Yoshida ..... 264/5
2009/0130382 A1* 5/2009 Otoshi et al. ..... 428/131
2009/0131255 A1* 5/2009 Ikeuchi et al. ..... 502/402
2009/0134046 A1* 5/2009 Breidenthal et al. ..... 206/221
2009/0136672 A1* 5/2009 Panz et al. ..... 427/397.7
2009/0136861 A1* 5/2009 Mitsumori et al. ..... 430/66
2009/0136913 A1* 5/2009 Breidenthal et al. ..... 435/3
2009/0136963 A1* 5/2009 Breidenthal et al. ..... 435/6
2009/0137029 A1* 5/2009 Breidenthal et al. ..... 435/287.2
2009/0137732 A1* 5/2009 Panz et al. ..... 524/588
2009/0139992 A1* 6/2009 Breidenthal et al. ..... 220/501
2009/0142745 A1* 6/2009 Breidenthal et al. ..... 435/3
2009/0142771 A1* 6/2009 Breidenthal et al. ..... 435/6
2009/0162097 A1* 6/2009 Fuchigami ..... 399/159
2009/0169775 A1* 7/2009 Mukunoki et al. ..... 428/1.31
2009/0169908 A1* 7/2009 Ueda ..... 428/534
2009/0180788 A1* 7/2009 Tamoto et al. ..... 399/48
2009/0180807 A1* 7/2009 Mitsumori et al. ..... 399/220
2009/0187000 A1* 7/2009 Nakai et al. ..... 527/300
2009/0192280 A1* 7/2009 Otoshi ..... 526/281
2009/0195877 A1* 8/2009 Nakai ..... 359/500
2009/0202274 A1* 8/2009 Mitsumori et al. ..... 399/159
2009/0205363 A1* 8/2009 de Strulle ..... 62/533
2009/0208249 A1* 8/2009 Fuchigami et al. ..... 399/159
2009/0208250 A1* 8/2009 Mitsumori et al. ..... 399/159
2009/0215808 A1* 8/2009 Yum et al. ..... 514/282
2009/0215891 A1* 8/2009 Brostrom et al. ..... 514/547
2009/0216910 A1* 8/2009 Duchesneau ..... 709/250
2009/0232552 A1* 9/2009 Mitsumori et al. ..... 399/159
2009/0240047 A1* 9/2009 Noritsune ..... 536/56
2009/0252805 A1* 10/2009 Piene ..... 424/490
2009/0257776 A1* 10/2009 Mitsumori et al. ..... 399/159
2009/0291380 A1* 11/2009 Ayaki et al. ..... 430/108.1
2009/0305090 A1* 12/2009 Chuang ..... 429/13
2009/0317144 A1* 12/2009 Koido ..... 399/284
2010/0010238 A1* 1/2010 Eger et al. ..... 549/257
2010/0046985 A1* 2/2010 Fuchigami ..... 399/159
2010/0054810 A1* 3/2010 Fuchigami ..... 399/159
2010/0062252 A1* 3/2010 Kimura et al. ..... 428/402
2010/0113653 A1* 5/2010 Ueda ..... 524/35
2010/0150606 A1* 6/2010 Tamoto et al. ..... 399/111
2010/0151366 A1* 6/2010 Nukada et al. ..... 430/56
2010/0158561 A1* 6/2010 Mitsumori et al. ..... 399/111
2010/0183330 A1* 7/2010 Wada et al. ..... 399/116
2010/0189993 A1* 7/2010 Mori et al. ..... 428/317.5
2010/0196624 A1* 8/2010 Ruuttu et al. ..... 427/569
2010/0210745 A1* 8/2010 McDaniel et al. ..... 521/55
2010/0216963 A1* 8/2010 Ueda ..... 526/348.1
2010/0221159 A1* 9/2010 Insley et al. ..... 422/211
2010/0229725 A1* 9/2010 Farsad et al. ..... 96/74

| | | | | |
|---|---|---|---|---|
| 2010/0230830 | A1* | 9/2010 | Farsad et al. | 261/20 |
| 2010/0233146 | A1* | 9/2010 | McDaniel | 424/94.2 |
| 2010/0273091 | A1* | 10/2010 | Brey et al. | 429/513 |
| 2010/0316411 | A1* | 12/2010 | Mitsumori et al. | 399/159 |
| 2010/0316412 | A1* | 12/2010 | Mitsumori et al. | 399/159 |
| 2011/0045391 | A1* | 2/2011 | Maeda et al. | 430/56 |

FOREIGN PATENT DOCUMENTS

| | | | | |
|---|---|---|---|---|
| JP | 59137389 | A | * | 8/1984 |
| JP | 62164509 | A | * | 7/1987 |
| JP | 62226156 | A | * | 10/1987 |
| JP | 63210186 | A | * | 8/1988 |
| JP | 63255211 | A | * | 10/1988 |
| JP | 01009862 | A | * | 1/1989 |
| JP | 01012246 | A | * | 1/1989 |
| JP | 01155969 | A | * | 6/1989 |
| JP | 01215890 | A | * | 8/1989 |
| JP | 02071767 | A | * | 3/1990 |
| JP | 02086835 | A | * | 3/1990 |
| JP | 02096532 | A | * | 4/1990 |
| JP | 02232070 | A | * | 9/1990 |
| JP | 05139809 | A | * | 6/1993 |
| JP | 06248205 | A | * | 9/1994 |
| JP | 06316795 | A | * | 11/1994 |
| JP | 07257958 | A | * | 10/1995 |
| JP | 07279782 | A | * | 10/1995 |
| JP | 07291758 | A | * | 11/1995 |
| JP | 08000708 | A | * | 1/1996 |
| JP | 08035453 | A | * | 2/1996 |
| JP | 08104609 | A | * | 4/1996 |
| JP | 08150339 | A | * | 6/1996 |
| JP | 09110468 | A | * | 4/1997 |
| JP | 10099694 | A | * | 4/1998 |
| JP | 10117953 | A | * | 5/1998 |
| JP | 10165820 | A | * | 6/1998 |
| JP | 10243993 | A | * | 9/1998 |
| JP | 11080512 | A | * | 3/1999 |
| JP | 11246253 | A | * | 9/1999 |
| JP | 2000169334 | A | * | 6/2000 |
| JP | 2000233929 | A | * | 8/2000 |
| JP | 2001029488 | A | * | 2/2001 |
| JP | 2001031049 | A | * | 2/2001 |
| JP | 2002180064 | A | * | 6/2002 |
| JP | 2002249782 | A | * | 9/2002 |
| JP | 2003053817 | A | * | 2/2003 |
| JP | 2003252674 | A | * | 9/2003 |
| JP | 2004058027 | A | * | 2/2004 |
| JP | 2004137641 | A | * | 5/2004 |
| JP | 2005226008 | A | * | 8/2005 |
| JP | 2007277434 | A | * | 10/2007 |
| JP | 2010265144 | A | * | 11/2010 |
| WO | WO 2004052386 | A1 | * | 6/2004 |

* cited by examiner

METHOD AND MACHINE FOR THE SINTERING AND/OR DRYING OF POWDER MATERIALS USING INFRARED RADIATION

BACKGROUND OF THE INVENTION

Field of the Invention

Specifically, the invention refers to a machine that is specially designed for the agglomeration and/or drying of powdered materials, through the application of infrared radiation by a process that will be explained in more detail further on. Other processes exist in the market that are used to achieve the same result, such as wet and dry compacting, pelletization, spray drying, wet extrusion and wet granulation, which are considered as State of the Art. Pelletization is a process that is based on forcing a powder to go through an orifice, thus obtaining a symmetrical granule in the form of a cylinder. This process may be carried out either wet or dry format and is restricted to granules with a cylinder diameter of at least few millimeters. The dry version lacks versatility, given that each product will require a different matrix.

Spray drying is a process that requires that the solid is dispersed and/or dissolved in a liquid to later be pulverized and exposed to a current of dry air to remove the water. The obtained granules have a particularly small particle size of 20 to 300 microns, and the energy cost for this type of process is high.

Extrusion is a procedure, which involves passing a material of pasty consistency (it could either be a melt or a solid/liquid blend) through orifices using a turning screw. It then proceeds to be sliced, cooled and/or dried and from this we obtain the granules.

Wet granulation is another known procedure, which involves pulverizing a powdered solid with a moving liquid to give granules that are later dried.

BRIEF DESCRIPTION OF THE RELATED ART

Other previous literature includes the German patent DE-3446424A1 and U.S. Pat. No. 5,560,122.

The patent DE-3446424A1 describes an IR radiation application to dry solid materials, where IR emitters are located inside a rotating drum with cooled walls, which permits the drying of solids via a batch process. This invention presents certain disadvantages, which are resolved using this new technique. The new technique described below presents the following comparative advantages:

- It is applicable in both batch and continuous drying processes, not just batch.
- The vessel walls do not become heated due to the fact that the IR radiation is selectively applied to the product. In the previous system, both the walls and the product that sticks to the walls reach higher temperatures than the main bulk of product to be dried. This is because the walls are exposed directly to IR radiation and may risk the product quality, as usually happens due to excessive temperature.
- The present invention has a system for breaking up the lumps that are often formed, which the previous patent does not possess.
- The present invention avoids the surface deposits of product inside the dryer, which can lead to the deterioration of the product due to excessive and prolonged heat exposure.
- The dynamic of the movement of the dried bed minimizes the creation of dust clouds, unlike the previously mentioned patent, where the generated dust tends to cover the IR radiation source. This may also lead to product deterioration.

The U.S. Pat. No. 5,560,122 is also a batch process apparatus, which is used for the blending, wet granulation and post-drying of pharmaceutical products through four different methods. The drying methods include contact, IR radiation via an external window, the injection of hot air and vacuum. This second invention also presents certain disadvantages, which are resolved by the new technique. The comparative advantages of the new technique are the following:

- It is applicable in both batch and continuous drying processes, not just in batch.
- Only one single source of energy (IR radiation) is used, instead of four sources: contact, IR radiation via an external window, the injection of hot air and vacuum.
- Being direct the transmission of the IR, its efficiency is much higher and it reaches a much wider surface area, unlike the patent previously mentioned, where the imposition of a glass window limits the surface exposure. This window not only causes a loss of radiation intensity but also requires the window to be cooled due to the absorbed radiation by the glass and the over-heated product that sticks to the inner side of the window. This adhered product may deteriorate and therefore it could contaminate the agglomerated material if it comes loose.

The advantages of this new procedure when compared to the current techniques, such as wet and dry compacting, are that it does not require post-treatments like the granulation (size reduction) of the compacted product sheets, and neither drying. The particles obtained from the new technique can be much smaller, with spheroid shape, and less content of dust and more attrition resistant, all of which makes the material more free-flowing.

Furthermore, other advantages should be taken into account, such as the energetic savings that come from not having to evaporate so much water and from the fact that the volume of the required equipment is much less. With respect to extrusion, where the products are fused, the new technique offers significant advantages: critical steps such as passing through the orifice and product slicing can be avoided, the particle size is smaller, and the particle spherical shape. These improvements are basically in final application, storage and transportation of the final product.

The energetic efficiency of the new procedure is not significantly influenced by the shearing stress of the extrusion screw. Thus, due to it operates with very minor shear stress the deterioration of the product is very low. The ease of processing products of low bulk density does not reduce production. The presence of volatiles is not problematic given that gases do not end up trapped inside the barrel, as happens for example with extrusion. Thus degasification is not necessary. Furthermore the temperature, which must be reached by the product to become granulated, is less. This not only increases energetic efficiency but also causes less damage to thermally unstable products. The new technique leads to greater process control and far less energetic cost.

On the other hand the described technology presents a notable advantage, compared to the wet granulation process, when melted components are present, as they can act as an agglomerating agent thereby rendering the later steps of pulverization and drying unnecessary. In the case of the liquid pulverization procedure, which is also described herein, the system has the advantage of combining both the wet granulation and the drying into the same equipment.

The technical sectors to which the new invention is directed include among others the chemical, pharmaceutical, agrochemical, food, iron/steel, plastics, ceramic, rubber, fertilizer, detergent, powder coatings, pigment and waste treatment industries.

OBJECT OF THE INVENTION

The objective of this invention is to improve the material handling and flow of the product, avoid the risk of lumps formation, facilitate the dosing, reduce the risk of dust cloud explosions, prepare the product for direct compression, reduce user exposure and any other associated product risks.

With the new method, several functions can be carried out in just one unified unit, whereas up until now each of these functions have required different machines. This can be explained via three application fields, each titled by way of example below:

- The first field is for products that need to be dried with solvent recovery. The new technique allows for the production of dry, powder or granular product with the aforementioned machine; whereas conventionally one would require various machines disposed in series: a dryer with solvent recovery, a cooler of powder dried product, an intermediary silo for the powder product, and a sieve for fine-particle recovery.
- The second field is to obtain a granular product comprised of several components in powder form with total or partial product melting. The new technique permits the production of granular material composed of various powder components in one single equipment; this considering that what is usually required is a mixing and fusion machine (extruder) and a water-cooled heat cutter positioned after it, followed by an air dryer to remove the water and finally a sieve to separate the fine particles from the coarse ones.
- The third field deals with obtaining a granulated product to be directly compressed into tablets, starting from filter press cake. Using a single unit the new technique allows for the production of granular product, which is known in the pharmaceutical industry as "Direct Compression" (DC) quality. Usually this would require several machines in series, such as a dryer with solvent recovery, a cooler of powder product, a intermediary silo for the powder product, a compactor, a granulator (particle size decrease) and a sieving set.

The invention procedure is based on the application of infrared radiation on moving powder form material with the aim of producing particles of agglomerated material. Depending on the material's composition, the absorption of radiation produces different effects: if the blend includes compounds with low melting points, a partial fusion occurs; and if the mix includes volatile compounds, the material is dried. In general, both phenomena may occur. Each of the effects is used to create agglomerate particles of a controlled size.

The material to be processed can be wet, as in the case of the filter press cake, or dry with low or no volatile substances content. The material may also be composed of a single compound or several ones. In the case of several compounds, the process simultaneously performs a homogenous blend.

If the solvent medium is a liquid, this can be easily recovered from the generated vapours by condensation, first having the machine suitably sealed. If on the other hand the products are dry, the agglomeration with the aforementioned machine can follow two different routes:

- The first involves the partial melting of some of the starting material components, which will in turn act as an agglutinant.
- The second way is to spray the material with a liquid which dissolves one or more components of the initial material, or which contains components that act as agglutinants themselves. If the liquid is volatile, it is evaporated by a further application of IR radiation.

The procedure can also be adapted to either batch or continuous processes. In both cases, the material flow inside the equipment can follow a Plug-Flow reactor (PFR) model or the Completely Stirred Tank Reactor (CSTR) model or any intermediate material flow between these two ideal models.

The source of IR radiation should ideally be a ceramic or metallic surface, which emits radiation via the Plank effect with superficial temperatures that oscillate between 200° C. and 3000° C. The source of this radiation energy is usually electric, although other alternatives such as direct combustion of liquid or gaseous fuels may be applied in those processes where said cheaper energy sources are required.

Further details and features of the method and machine for the agglomeration and/or drying of powder materials using infrared radiation will be clearer from the detailed description of preferred embodiments, which will be given hereinbelow by way of non limitative examples, with reference to the drawings herein accompanied, in which:

DESCRIPTION OF THE PREFERRED EMBODIMENT

Figure 1:
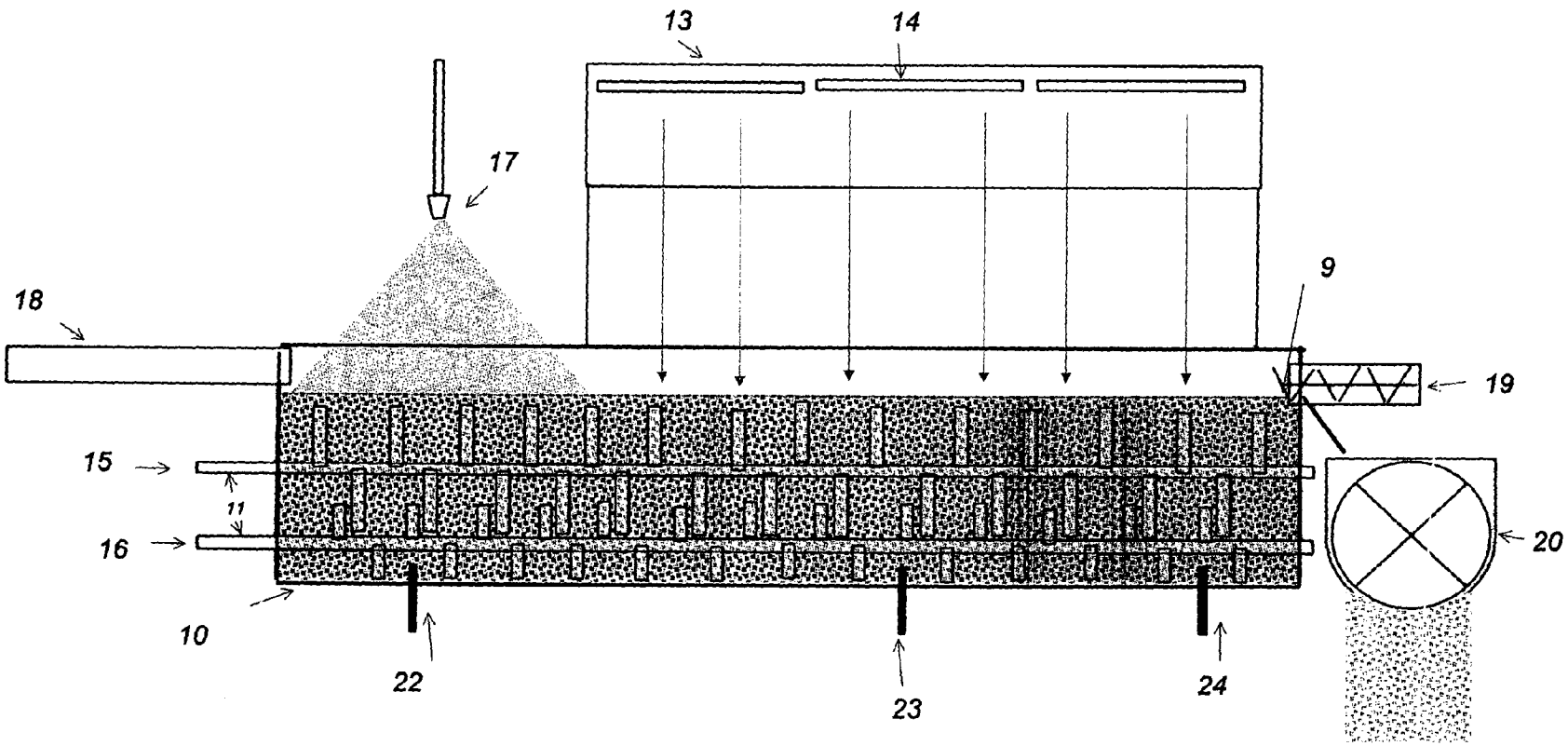
FIG. 1 is a front elevated schematic view of the machine according to the invention in a non-airtight version, in which each of the different parts can be seen. The machine is conceived for working in continuous with pulverization provided with a crusher axis.

There follows a detailed and numerated index to define the different parts in the embodiments of the invention as shown in the figures annexes: (2) set of valves, (10) vessel, (11) shafts, (12) blades, (13) focusing screen, (14) IR source, (15, 16) mixing elements, (17) spray, (18) product, (19) screw, (20) granulator, (22, 23, 24) sensors, (25) vent, (26) rotary valve, (28) cover and (29) vacuum outtake.

The continuous operation mode is a preferred patent option.

Operation in Continuous Mode A:

The machine is continuously fed with the different components of the formula to be dried and/or granulated (18), this is done in such a way as to control their mass input flow into the vessel (10). The mass will be stirred with a rotating shaft (11) with blades (12). It is provided multiple stirring shafts (11), but al least two. These two stirring shafts are designated in the drawings as references (15) and (16).

A focusing screen (13) containing the IR source (14) is located above the vessel (10). The power of this infrared radiation source (14) is regulated by measuring the source temperature or, in case of direct combustion, controlling the flows of fuel and air.

The stirring elements (15) and (16), which are comprised of rotating shafts (11) with blades (12), ensure a rapid renewal of the product exposed to the surface of the vessel, which contributes to a higher homogeneity of the drying and/or granulating process.

It exists two different type of stirring elements (15 and 16), which revolution velocities can be regulated independently.

The upper stirring element (15) rotates at a lower velocity and its basic utility is to renew the product located on the upper surface of the mass and mix it more evenly with the product located further down in the mass.

The main purpose of the lower stirring element (16), whose presence is optional, is to break up those agglomerates that exceed a certain size using its greater rotating velocity.

The shafts of the stirring elements (15 and 16) can be extracted in order to facilitate cleaning tasks and product changes. These shafts (11) are designed is such a way as to allow blades (12) of varying their length, width, thickness and inclination (of the angle with respect to the rotating axis), in order to adapt to the desired properties of the final product. These characteristics determine the flow dynamics of the product inside the machine.

These variations in the length, width, thickness and inclination of the blades (12) are achieved by either substituting them with other blades of a different size/shape, or indeed by using blades specifically designed to allow a certain degree of adjustment of the aforementioned parameters.

The length and dimensions of the blades (12) allow a self-cleaning effect, given that the blades (12) of one shaft (11) intersect with the blades (12) of the adjacent shafts (11). The tolerance (gap) between adjacent crossing blades can be adjusted by means of changing and/or modifying the blades (12). The potential deposits of product on the outer surface of the shafts (11) are removed continuously by the end point of the blades of the adjacent shaft; see FIG. 2.

The blades (12) are usually inclined with respect to the advance of the rotation direction so that they also produce an auto-clean effect. The inclination of the blade (12), with respect to the turning shaft (11) for a given direction of turn, controls the axial direction in which the product advances. This circumstance is used to regulate how the product advances and can also be used to improve the axial mixing of the product by combining different advance/hold back properties of adjacent blades (12) of the same shaft (11), enhancing thus the mixing effect in axial direction. In this way a homogenous distribution of the product can be achieved in surface, both laterally and axially; said homogeneity is recommendable when opting for a batch process. The two shafts (11) should preferably rotate in opposite directions to maximize the blending.

In order to avoid deposits of the product on the inner surface and/or dead zones, the tolerance (space) between the outer points of the blades (12) and the inner surface of the vessel (10) is minimum. This space can be regulated by means of changing the length of the blade (12). The maximum length value is based on the criteria of approaching the gap size to the desired average particle size. If this value is lower than the standard mechanical design permits, the value will adjust to the one that is recommended in this design.

If the addition of a liquid via a spray (17) is chosen, the flow is adjustable according to the quantities required. This function can be applied before, during or after the IR radiation. The pulverization may be air-assisted and should operate preferably with droplets of low average size (1-200 microns). The quantity of liquid added can vary between 3 and 40% of the weight of the final granulated/dried product.

The agglutinating material can be either a liquid or a melted solid. The liquid can contain dissolved solids, dispersed solids or other dispersed non-miscible liquids.

The continuous extraction of the final product is achieved by overflow when it exceeds the level at the discharge point (9), which is located as far as possible from the feeding point. The height of said discharge level is adjustable. In the case of heavy lumping, the product may be forcibly extracted via a screw (19) with adjustable velocity.

Once the product is discharged, the maximum particle size of the product can be guaranteed by installing a granulator (20), which continuously will crumble the coarse particles: it will force the product through a metal mesh whose aperture size equals the maximum desired particle size.

The granulator (20) installation is optional, given that in most applications the quality of the granule obtained from the machine regarding the particle size is already satisfactory.

If the final product has not to contain particles below a certain size (fines), a sieve (not included in figures) may be placed afterwards, and the fines recovered here can be continuously recycled back into the feed of the process.

The product usually requires cooling before it is packaged and room-temperature air is preferably applied while the product is being transported by vibration, by screw or by fluidised bed. The cooling phase can be carried out immediately after discharge and/or before the granulation/sieving step, depending on the nature of the product.

Both the vessel (10) and the screen (13) are externally covered with thermal insulation material to minimize energy loss and also to avoid the accidental burning of the personnel who are running the machine.

The focusing screen (13) is designed to have an adjustable height in relation to the upper surface of the vessel (10). This allows one to vary the distance between the emitting elements and the product surface between 3 cm. minimum and 40 cm. maximum.

Figure 2:
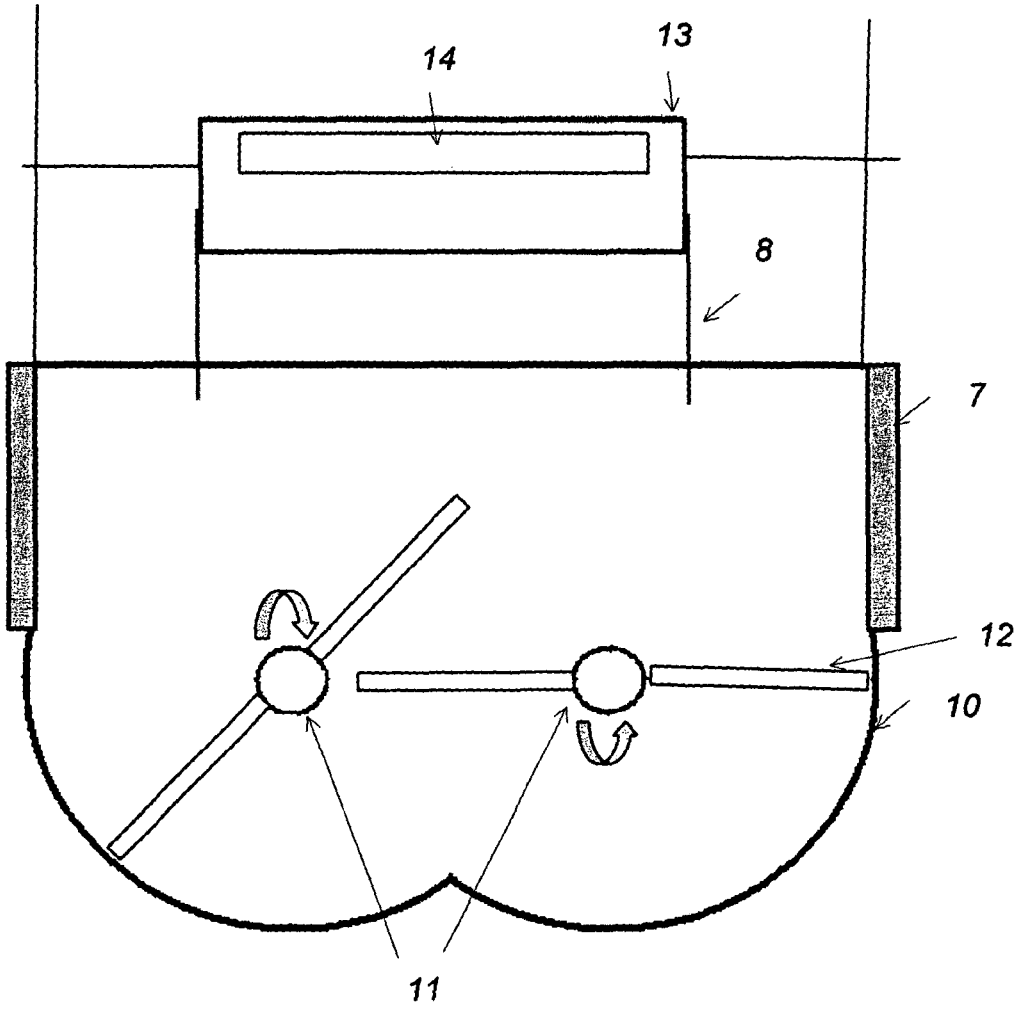
FIG. 2 is an elevated cross-sectional schematic view of the machine according to the invention in a non-airtight version, to be operated in continuous form with only two mixing shafts and without a crusher shaft.

To achieve good final product uniformity, it is important that local overheating above working temperature does not occur in any part of the vessel (10). This is obtained thanks to a combination of the following elements:

a) The internal surface of the vessel (10) is highly reflective to IR radiation and has a metal mirror-finish. The coating includes aluminium, nickel, silver, zinc, etc. This finish also reduces the adherence of product and facilitates cleaning.

b) The area irradiated does not cover the entire upper surface of the product exposed to the air, so the incidental radiation that comes from the source is practically negligible in strip form area surrounding the internal perimeter of the vessel, see FIG. 2.

c) The use of thin disposable reflective sheets of metal (8) placed at the edge of the focusing screen (13) to minimize the radiation likely to reach the wall of the vessel (10), see FIG. 2.

d) Refrigeration of the fraction of the vessel wall (7) directly exposed to radiation, see FIG. 2.

The use of one or more of these elements will depend on the inherent requirements of the desired product.

The correct parameters to achieve a suitable granulation and/or drying are determined by previous testing, which allow defining the operating temperature, the intensity of radiation, the flow of product and the stir velocities required to achieve a desired product (particle size-distribution, volatile content, etc.).

There are various sensors (22, 23 and 24) located inside the vessel (10). They are submerged in the product and measure its temperature, which allows controlling the process during start up and during continuous stationary state. At the same time, they give a good indication of the flow's condition of the product along the length and width of the vessel (10).

The described process also applies when the production requires a controlled atmosphere. This controlled atmosphere can be in terms of pressure that are above or below atmospheric, or can be in terms of composition ($N_2$, $CO_2$, etc.). In both cases the granulating/drying machine must be sealed as described. The composition of the atmosphere that surrounds the product can be controlled adjusting the inert gas flow (25), see FIG. 3.

For continuous processes airtight or semi-airtight elements are necessary, which can allow the continuous or semi-continuous feeding and continuous extraction of the material. For this purpose 8-blades rotary valves (26) or systems of two valves with an intermediate chamber where one of the two valves (2) is always closed are employed.

The vacuum outtake and and/or outlet for volatile vapours are installed in the cover (28) for (29).

With regards to the airtight sealing of the IR source and the vessel, a cover (28) is used, which covers the perimeters of both these elements with an elastic seal. If the pressure inside is below atmospheric, there is no need for any additional attachments, as the vacuum effect itself will maintain the seal of the elements. If pressure above atmospheric is required, it is essential to attach pressure screws to ensure that the cover and vessel remain joined together. The shafts (11) have suitable tight sealing with gasket or packing glands.

In the case where solvent recovery is required, the equipment will be sealed and the generated vapours recovered via condensation by a cooling unit placed between the cover and the vacuum generator. In the case of operating without vacuum, the vapours will be condensed before being released into the atmosphere.

Operation in Batch Mode B:

The operation mode of this system differs from the previous continuous system A in that the quantities of different solid components to be granulated/dried are added to the vessel (10) at the beginning of the process. They are then mixed.

If drying is all that is required, one simply connects the IR source.

If granulation is required via the addition of a liquid spray, this is done at the beginning, gradually adding the required quantity.

Once the mass has been homogenously mixed and/or fully agglomerated into granules, the drying, if required, begin by connecting the IR source.

If the agglomeration occurs through a melted component, the IR can be applied during the mixing process.

Once the product had been granulated and/or dried, which you can judge by its physical aspect and by the temperature reached, it is discharged. The batch machine has a discharge door in its lower part so that it can be completely emptied.

Both the revolutions of the shafts (11) and the power emitted by the focusing screen (13) can be adjusted throughout the batch process to improve the homogeneity of the mix, to reduce the formation of dust clouds and to increase the efficiency and consistency of the process.

Figure 3:
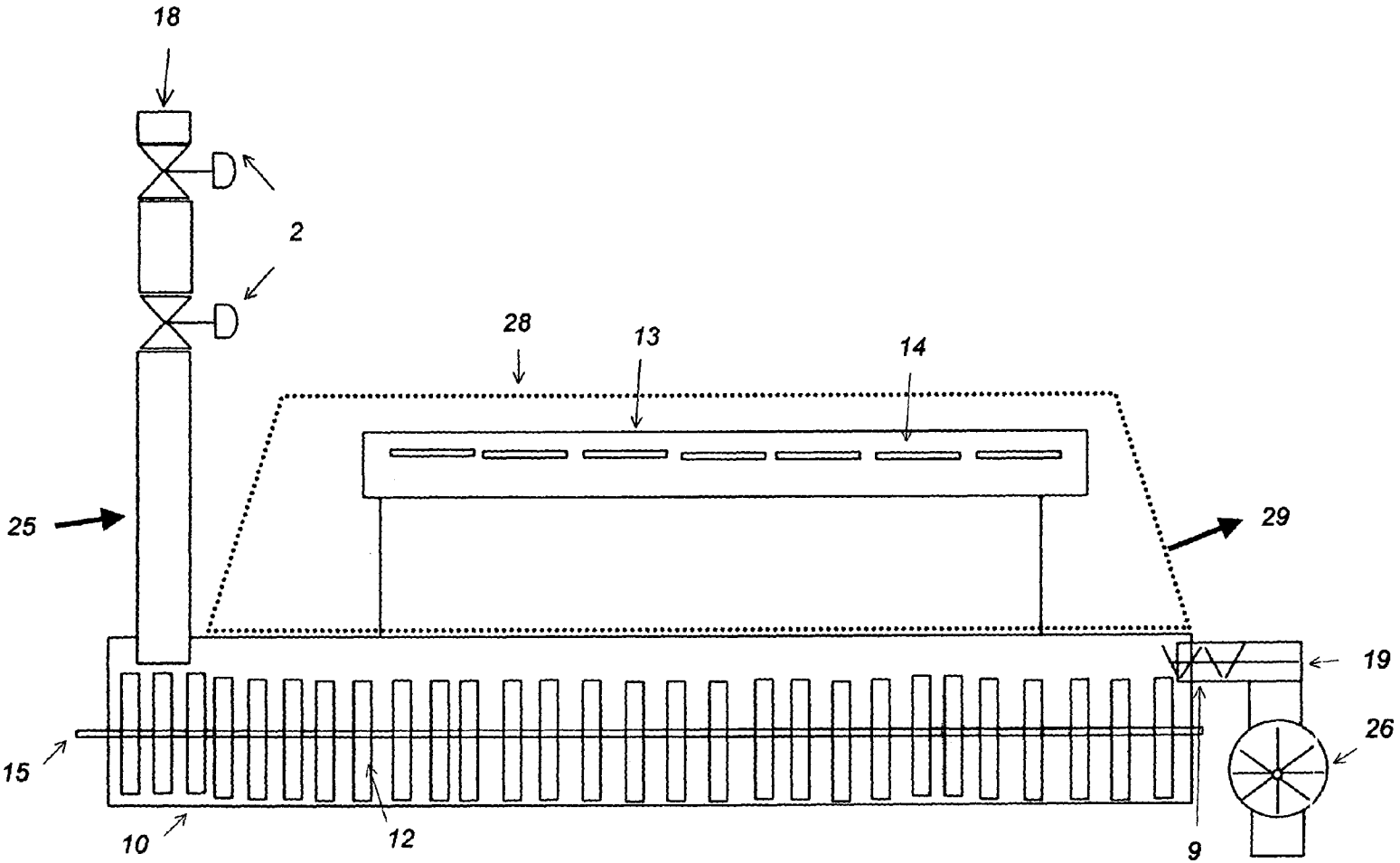
FIG. 3 is a front elevated schematic view of the machine according to the invention in an airtight version, in which each of the different parts can be seen. As such it can operate in continuous form but without a crusher shaft.

The shape and size of the batch machine can differ substantially from the images shown in FIGS. 1, 2, and 3. This is because the required capacity of the machine tends to be greater in order to produce large batches. In the batch process the quantity of product per unit of irradiated surface would be much higher than in a continuous process. The design of the stirring elements and placing of a door is such as to permit the complete emptying of the product once the batch process is completed.

The sealing elements for a batch machine are much simpler, as they only have to isolate the vessel and IR source from the surroundings.

Once this invention having been sufficiently described in accordance with the enclosed drawings, it will be understood that any detail modification can be introduced to the machine as appropriate, unless variations may alter the essence of the invention as summarized in the appended claims.

The invention claimed is:

1. A method for the agglomeration of materials originally in the form of dry powder or wet cake to obtain solid granules and/or for drying wet bulk materials to obtain dried powdered or agglomerated material, through the use of infrared radiation, wherein the energy source of IR radiation applied is electric or direct combustion of liquid or gaseous fuels, wherein the method is carried out in one single unit and, in continuous or batch mode and comprising the following steps:

Feeding powdered component materials to a product entry point into a vessel;

Homogeneous mixing and stirring the powdered component materials with at least two counter-stirring shafts with attached blades that they intersect between the blades of the adjacent shaft, providing a self cleaning configuration that prevents product deposits on the blades, shafts and vessel inner surface, avoids product dead zones, breaks up agglomerates that exceeds a predetermined size, avoids product dead zones and allows to adapt internal product mass flow dynamics to Completely Stirred Tank Reactor (CSTR), Plug-Flow Reactor (PFR) or intermediate configurations;

Applying IR radiation above product upper surface which is continually supplied with renewed powder by an infrared source located inside a focusing screen, and such that the area irradiated does not cover the entire upper surface of the product and so that incidental radiation from the source is negligible in a strip form area surrounding an internal perimeter of the vessel, maximizing IR energy yield by external covering of IR screen and vessel with thermal isolation material;

On continuous method mode continuous discharge of agglomerated product from the vessel by adjusting a height of an overflow port at an end of the vessel opposite product entry point into the vessel or on batch method a completely finished product discharge by a door located at the lower part of the vessel.

2. The method of claim 1, including further the step of adding liquid agglutinating material to the mixture of powdered component materials via pulverization to form granules from the powdered component materials.

3. The method of claim 1, wherein the process is carried out in airtight conditions allowing to work at pressure bellow or above atmospheric and/or in a controlled atmosphere composition adding an inert gas flow, wherein process generated vapors are recovered as liquid by condensation; a pressure bellow atmospheric is applied in processing materials sensitive to high temperature drying conditions and the addition of inert gas flow allows a safe processing of materials showing dust or solvent explosion risk in normal air oxygen content.

4. The method of claim 2, wherein the process is carried out in airtight conditions allowing to work at pressure bellow or above atmospheric and/or in a controlled atmosphere composition adding an inert gas flow, wherein process generated vapors are recovered as liquid by condensation; a pressure bellow atmospheric is applied in processing materials sensitive to high temperature drying conditions and the addition of inert gas flow allows a safe processing of materials showing dust or solvent explosion risk in normal air oxygen content.

* * * * *